US006425322B1

(12) United States Patent
Karlsson et al.

(10) Patent No.: US 6,425,322 B1
(45) Date of Patent: Jul. 30, 2002

(54) METHOD AND MEANS FOR HANDLING OF FORESTRY WASTES

(76) Inventors: Gösta Karlsson, Härdvägen 4, S-576 31; Erland Josefsson, Hjälmseryd, S-576 91, both of Sävsjö (SE)

( * ) Notice: Subject to any disclaimer, the term of this patent is extended or adjusted under 35 U.S.C. 154(b) by 0 days.

(21) Appl. No.: 09/534,327

(22) Filed: Mar. 24, 2000

Related U.S. Application Data

(63) Continuation of application No. PCT/SE98/01706, filed on Sep. 22, 1998.

(30) Foreign Application Priority Data

Sep. 25, 1997 (SE) ..... 9703461

(51) Int. Cl.[7] ..... B27M 1/02; B65B 27/10; B65B 11/26; B65B 63/04

(52) U.S. Cl. ..... 100/5; 100/155 R; 100/88; 53/211; 53/587; 144/2.1; 144/359; 144/329; 144/361

(58) Field of Search ..... 428/105, 107; 144/333, 358, 359, 361, 362, 329; 100/5, 15, 88, 89, 155 R, 162 R, 908; 56/341; 53/118, 211, 587

(56) References Cited

U.S. PATENT DOCUMENTS

| | | | | | |
|---|---|---|---|---|---|
| 3,780,646 | A | * | 12/1973 | Ancellin | 100/88 X |
| 4,212,149 | A | * | 7/1980 | Krone et al. | 100/88 X |
| 4,499,714 | A | * | 2/1985 | Hollmann | 100/88 X |
| 4,580,398 | A | * | 4/1986 | Bruer et al. | 100/5 |
| 4,841,851 | A | * | 6/1989 | Quataert | 100/5 |
| 4,917,008 | A | * | 4/1990 | Van der Wildenberg | 100/5 |
| 6,073,550 | A | * | 6/2000 | Goossen et al. | 100/88 |

* cited by examiner

*Primary Examiner*—W. Donald Bray
(74) *Attorney, Agent, or Firm*—Pillsbury Winthrop LLP

(57) ABSTRACT

The present invention is for a log made from wastes from forestry and the like material. The invention also is for means and method for the production of such log. The log comprises a sheath which surrounds the compressed forestry wastes of the log. A log according to the invention is produced by that forestry wastes is compressed. The goods are fed to a delimited space which corresponds to the outer shape of the log. In this space the goods are rotated around the lengthwise axis of the log to be during compression after which a holding, moisture releasing sheath is applied during rotation. In the compriming engine the log is formed inside the space which is defined by the compression rolls and the side walls including their movable side wall parts.

5 Claims, 7 Drawing Sheets

METHOD AND MEANS FOR HANDLING OF FORESTRY WASTES

CROSS REFERENCE TO RELATED APPLICATIONS

This application is a continuation of International Application No. PCT/SE98/01706 filed Sep. 22, 1998 which designated the U.S. and claims priority from Swedish Application No. 9703461.5 filed Sep. 25, 1997, the contents of both of which being incorporated hereinto by this reference.

The present invention is for method and apparatus for making a product from wastes from forestry, small pieces and similar things. The so obtained product takes the shape of a log.

BACKGROUND

The felling of trees causes large quantities of wastes, mainly branches and tops. To a certain extent there are also twigs, bark, parts of roots and unintentionally left over bigger parts of trees included in what is called wastes. It is desirable that these wastes from forestry are taken care of as far as possible and used, primarily as fuel.

The heretofore mainly used method for utilising the wastes is that they are gathered into huge, long piles for drying and thereafter are picked up by a truck or other vehicle. After being transported to a collecting centre they are disintegrated by cutting or other method. There is in many cases another transport to the place where the burning takes place. This method brings with it the transportation of large volumes and often in several laps with reloading in between. Further, there are often large quantities of needles and other small parts on the ground where the heaps have been. These residues remain on the spot when the wastes are picked up and have to be spread out or taken care of in another way before the ground can be prepared.

It is also know to compress the material in pressing machinery after it has been gathered, which process gives rectangular bales having sides one meter or more in length. Large presses are necessary in order to achieve sufficient pressing force and the compression may only be done in stationary equipment which causes a great need for transportation. The so obtained bales are large and ungainly which give rise to certain difficulties during the further handling.

The present invention is for method and apparatus for the production of a product from forestry wastes, small pieces and the like.

BRIEF DESCRIPTION OF DRAWINGS

The invention will below be described more in detail with reference to the embodiments which are shown in the enclosed drawings, in which.

DETAILED DESCRIPTION OF THE INVENTION

Figure 1:
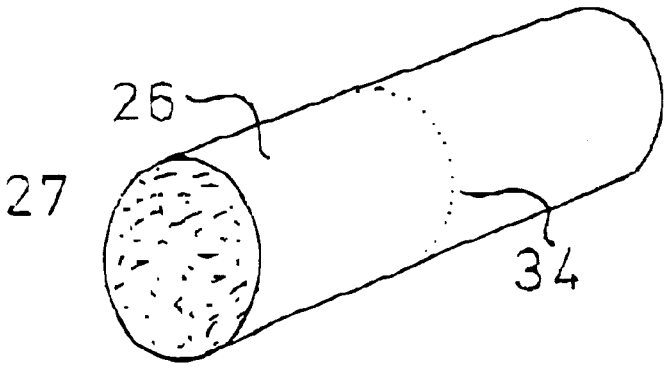
FIG. 1 shows a log according to the invention.
Figure 2:
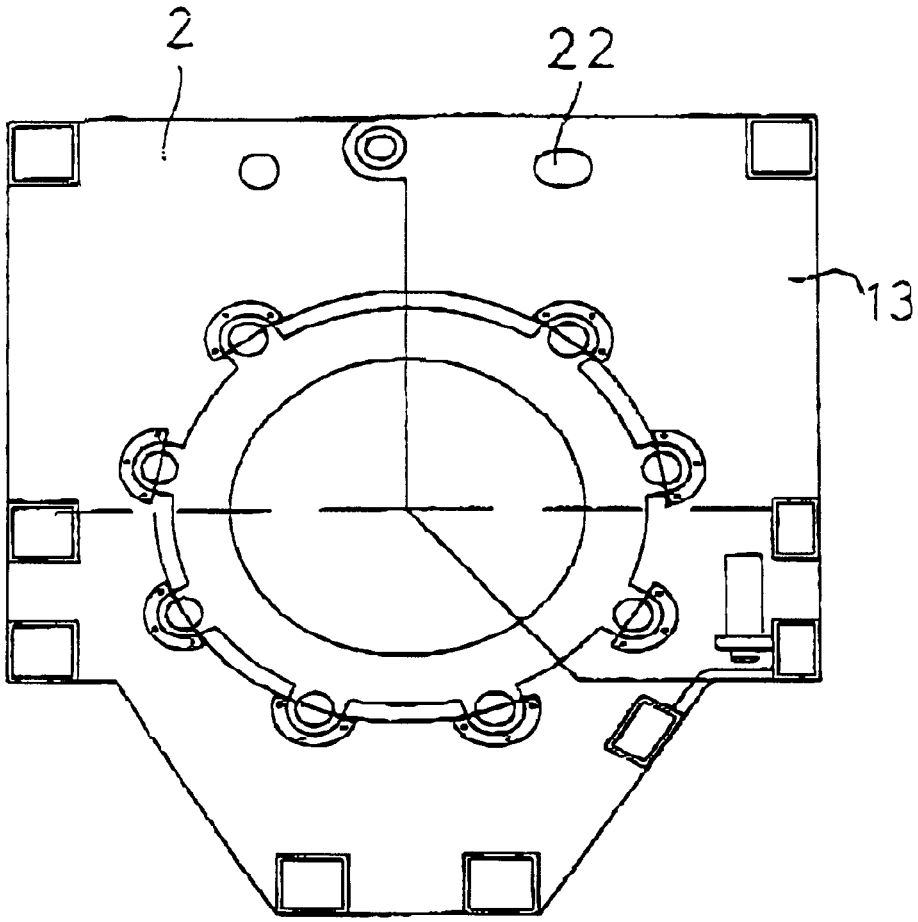
FIG. 2 shows apparatus according to the invention in side view.

The product shown in FIG. 1 is a log having a sheath 26 which surrounds the compressed forestry wastes 27 which are included in the log. Usually the wastes mainly comprise twigs and branches which during the compression are so directed that there lengthwise direction is the same as that of the log. The outer dimensions of the log are adjusted in accordance with the requirements of the further handling, which often means adaptation to the vehicle which is used for the transportation of the log to the place of use. Suitable dimension are in most cases a length of 2.5–3 m and a diameter of 0.5–0.8 meters. A log of these dimensions is also, for example, suitable for handling with the lifting cranes which usually are mounted on to the transportation vehicles which are being used.

The sheath 26 of the log may be made from paper which is reinforced by a net of fiberglass or the like in order to give sufficient strength to it. The sheath may also for example be a plastic film or foil and be perforated in order to make possible a sufficiently rapid drying under good conditions so that mould and such damages, which are caused by moisture, may be avoided. The perforations 34 of the sheath are preferably produced in connection with the compression of the goods and the production of the log as described below. A sufficient enclosure of the log is often possible by making the "sheath" from string, band or the like which is wound around the log in a sufficient number of rounds.

A log according to the invention has several advantages. It may be stored and dried outdoors at the spot where it is produced without leaving a residue of needles and other small parts on the ground after that it has been transported away. Further it may be transported without requiring specialised vehicles and it may be used either after disintegration or at the burning be fed into a furnace, whereby also the air for the burning may be fed in through the log.

A log according to the invention is produced by compression of wastes from forestry. The gods are then fed into a delimited space which corresponds to the outer shape of the completed log. They are brought to rotate in this space around the lengthwise axis of the log to be, whereupon a holding, moisture releasing sheath is applied during rotation. The rotating movement is brought about by the space being delimited by several compression rolls arranged closely adjacent one another and which together with two sidewalls delimit a space which corresponds to the outer dimensions of the log within a cylinder which touches upon the compression rolls. The speed of rotation is set so that the product is obtained mainly by the effects of the centrifugal force from the rotation while direct compression from the rolls is of small or no importance, the rolls mainly being supporting and motion transferring means. In this way it is achieved that the product which is formed is comparatively denser packed at its outer parts and has a more porous centre which means that the product dries faster than if it is produced by compression only. In this way a larger quantity of material may be included within a certain given total volume, i.e. the weight per volume can be increased compared to prior art methods. Faster drying brings with it advantages such as a shortened time of storage and reduced risk for formation of mould. In order to achieve this result the product ought to be rotated at a speed of 50–90 rounds per minute, preferably about 70 rpm. A further advantage is then achieved in that the material which is supplied is subject to some working so that bark of thicker parts is torn away. This provides for a more rapid drying and eliminates possible sites for broods of noxious insects. A further advantages is that the goods are ordered so that all their parts become parallel, as also do remaining branches at stem parts and tops.

Figure 3:
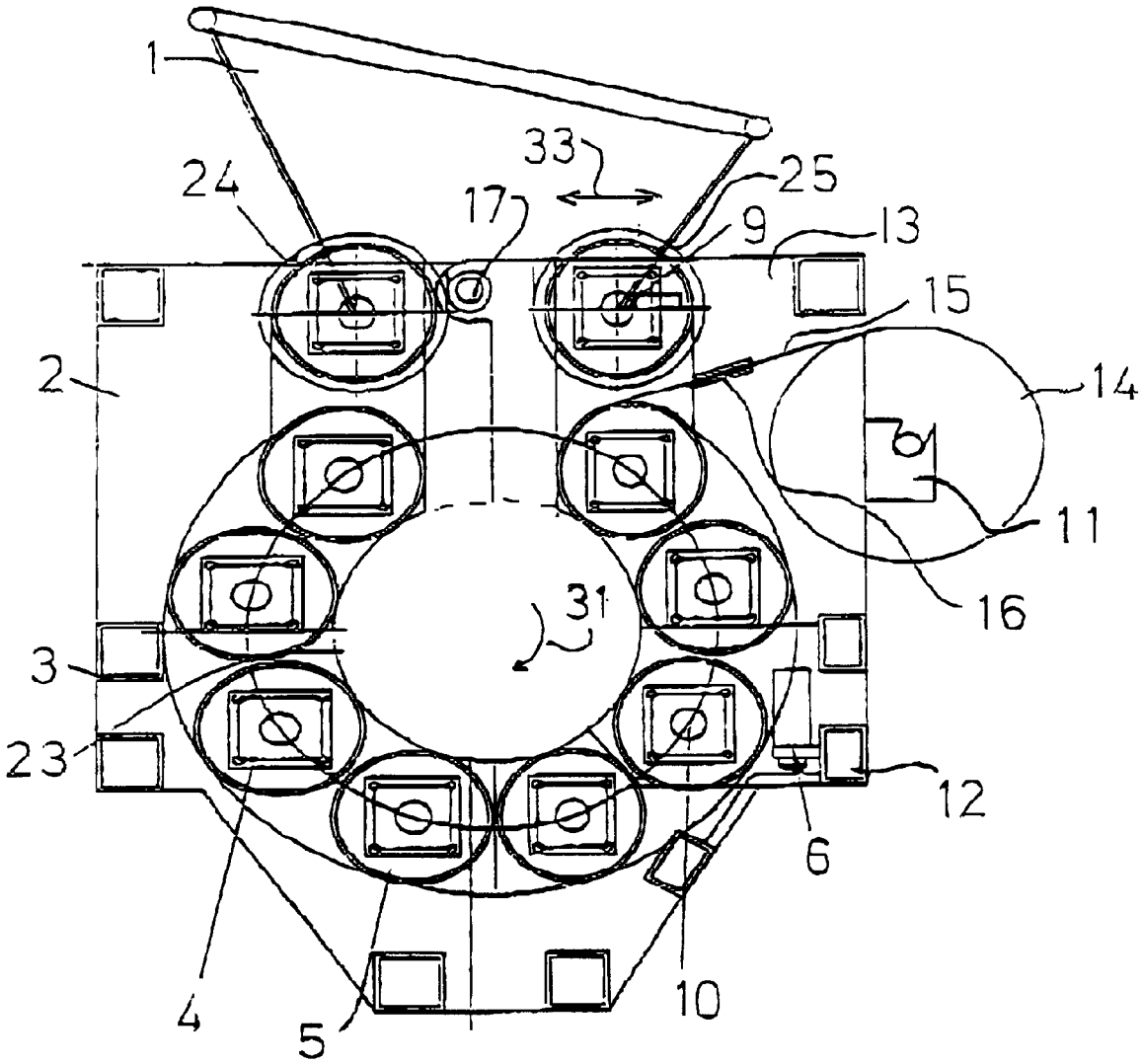
FIG. 3 shows a cross-section of the apparatus of FIG. 2.
Figure 4:
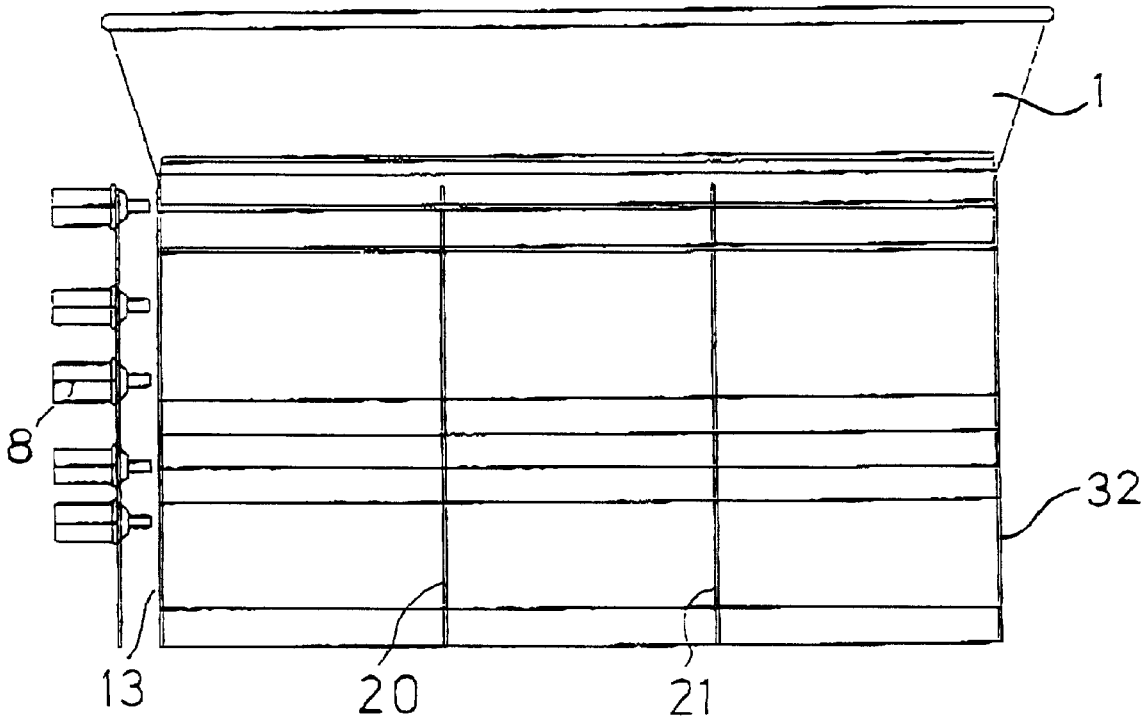
FIG. 4 shows in principle parts of the apparatus of FIGS. 2 and 3 from another view.
Figure 6:
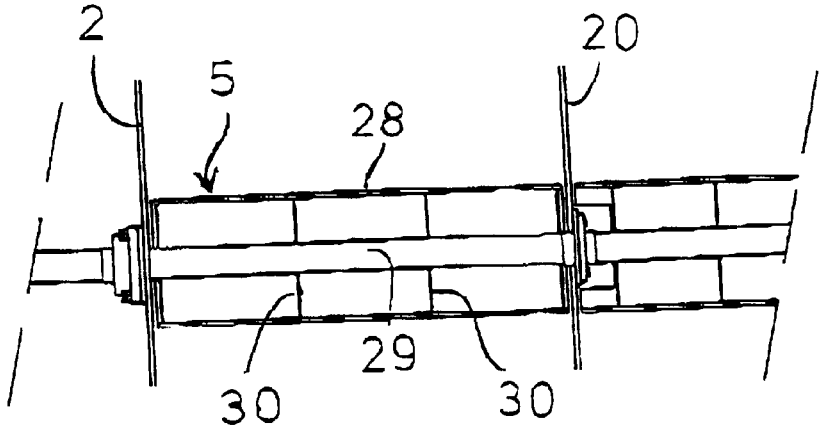
FIG. 6 is a cross-section of parts of a roll of the apparatus.
Figure 5:
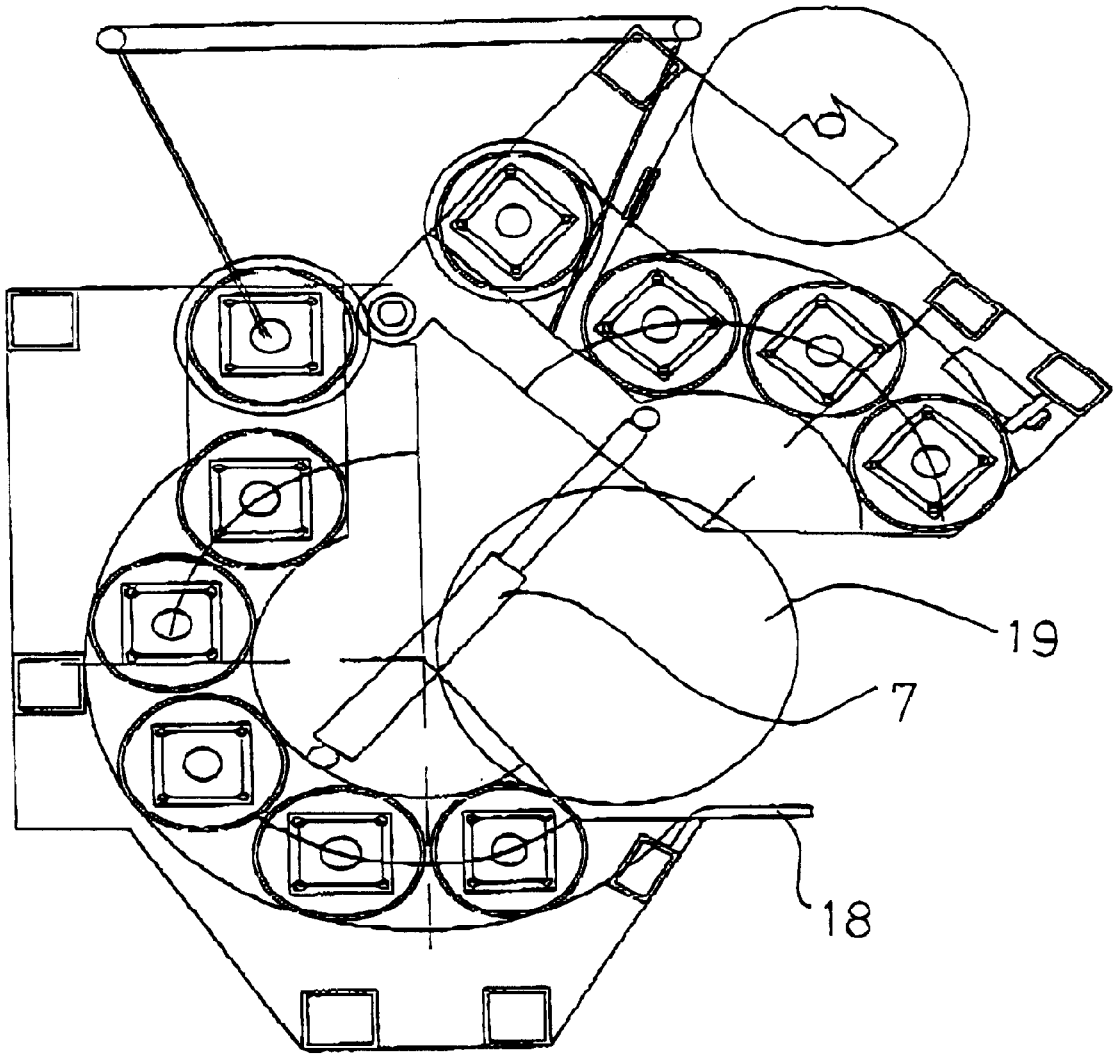
FIG. 5 shows the apparatus of FIG. 3 opened up.

In the compressing engine, which has a mounting frame with beams 3, 12, the log is formed within the space which is delimited by the compression rolls 5 and the side walls 2, 32 having movable gable parts 13. The rolls 5 are arranged with their axis of rotation 10, 29 bearing in a circle with bearings 4 which are mounted on to the side walls. Due to the length of the rolls they are divided into several, for example three, sections, between which there are supporting bearings at supporting walls 20, 21. The rolls 5 each have a casing 28 which by means of supporting walls or beams 30 are mounted at a shaft 29. The rolls do not form a closed circle but leave an infeed opening at the top for supply of material, i.e. forestry wastes. At the opening there are to feeder rolls 24, 25 on top of which there is arranged a hopper 1. The feeder rolls have spikes or similar means which are arranged from their middle as outward directed helixes to pull in goods and distribute the goods evenly over the whole width of the compressing engine. The feeder rolls are as usual counter rotating while the compression rolls 5 all rotate in the same direction so that the goods inside the compressing engine are rotated in the direction which is indicated by the arrow 31. In order to take care of the wide range of dimension which is frequent with forestry wastes at least one of the feeder rolls is movable so that it may be displaced as indicated by arrow 33 in FIG. 3. This is achieved by the rolls being mounted in oval holes 22 in the side walls and forced towards the opening by springs 9 of suitable kind.

The compressing engine is at its sides delimited by side walls 2, 32 at which there are bearings for the rolls. For the driving of the rolls there is for each roll a hydraulic engine 8 which is mounted at one of the side walls. The engines and the rolls are arranged so that all of the compression rolls 5 always rotate in the same direction and with the same speed. The degree of compression varies due to the fed in material. It is to be expected that a common size of the log will be a length of 3 m and a diameter of 0.7 m which corresponds to a volume of about 1.2 $m^3$. About 2.5 $m^3$ of forestry wastes are fed to the compressing engine for such a log which means that the reduction of the volume is more than 50%. The weight of the material is typically 300–400 kg.

The outer side walls 2, 32 are divided into one fixed part and one movable part 13. The movable part is pivotably arranged at a shaft end 17 at the fixed part of each side wall and is held in its operating position by a locking means 6. When a completed log is fed out the movable part of each side wall is lifted together with the rolls which are mounted there and other parts by turning around the shaft ends 17 so that an opening is formed through which the log 19 can be removed via the supporting board 18. Opening and closing of the compressing engine is suitably with the assistance of hydraulic cylinders 7, one on each side.

At the production of a log incoming material is continuously supplied during compression. That material which is to form the sheath is stored on a roll 14 in a holder 11 from which the length of material extends itself to a feeding and cutting means 16. The material for the sheath may be paper, net, string, band or other suitable material, string band and the like may be stored on several rolls which are arranged in parallel. At the starting position the material extends itself through the holder 11 to the first roll. When all of the goods have been supplied and compressed the holder 11 is actuated to move in a direction towards the first roll whereby the sheath material is brought along with the movement and is clamped between the compressed goods and the first compression roll. The sheath material is pulled one or more rounds 23 around the compressed material. At the same time the material is, in some cases, perforated with one or more rows of holes 34, thereby, at least one of the compression rolls has a row of sufficiently long extending spikes of sufficient length. After enough sheath material has been supplied it is cut between the first of the rolls 5 and the holder 16 and may be fixed, for example by a string of glue, and the log is taken out from the compressing engine.

Figure 7:
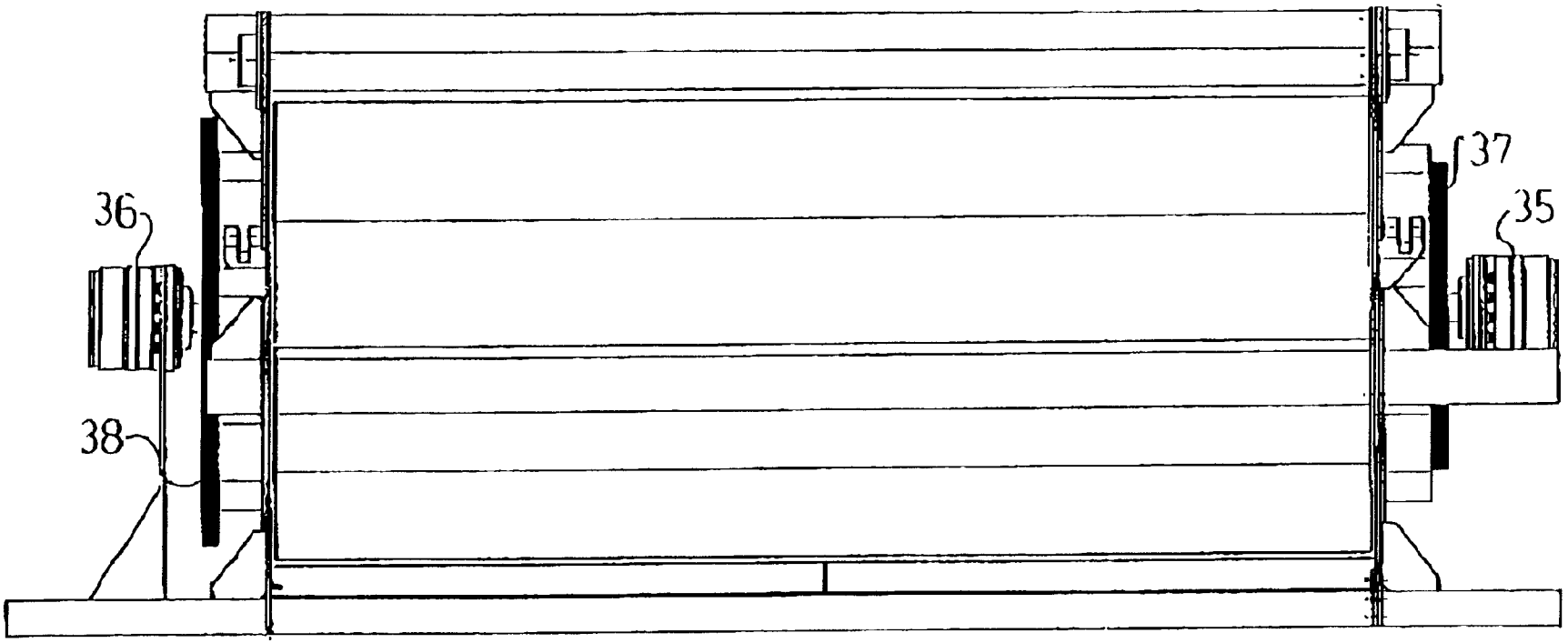
FIGS. 7–9 show some views of a preferred embodiment of the invention.
Figure 8:
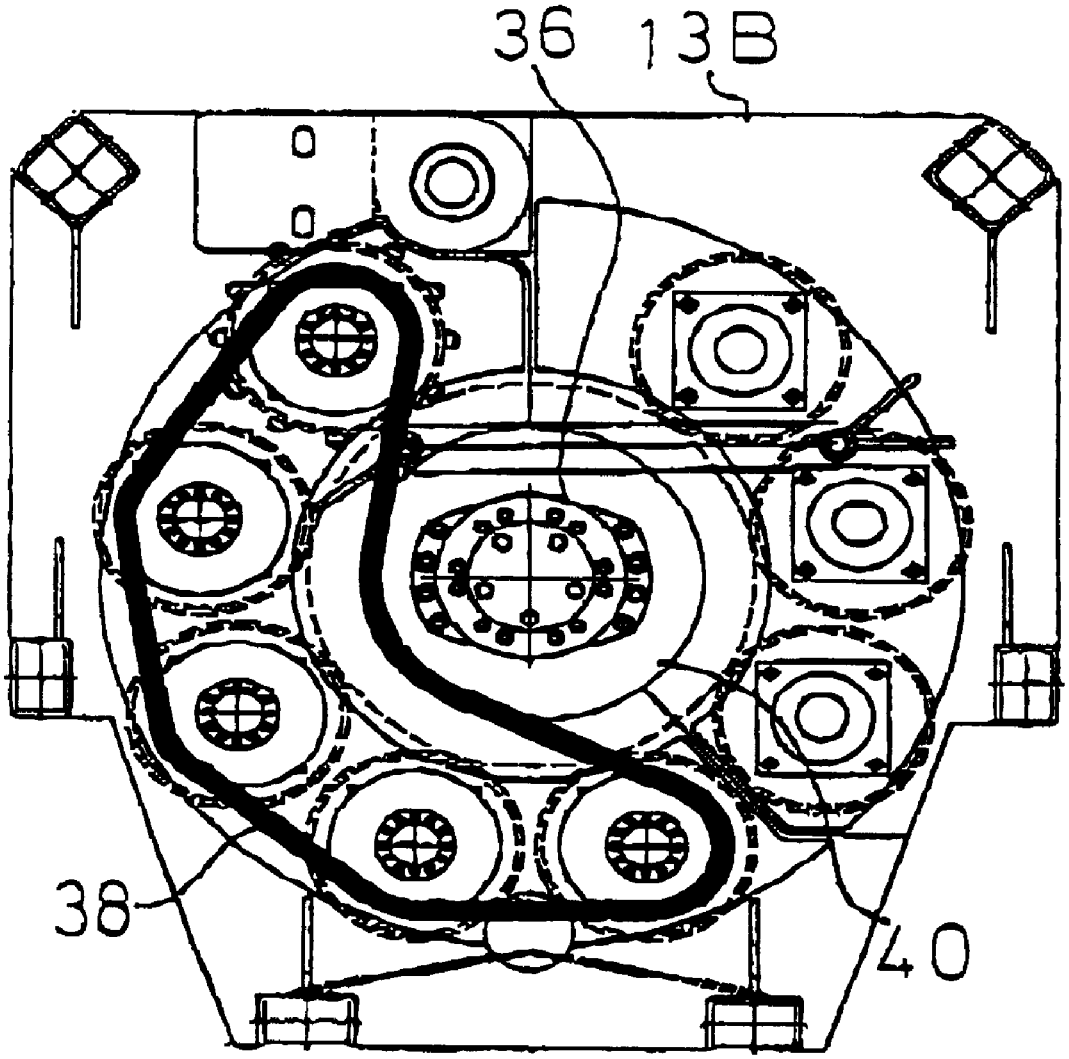
Figure 9:
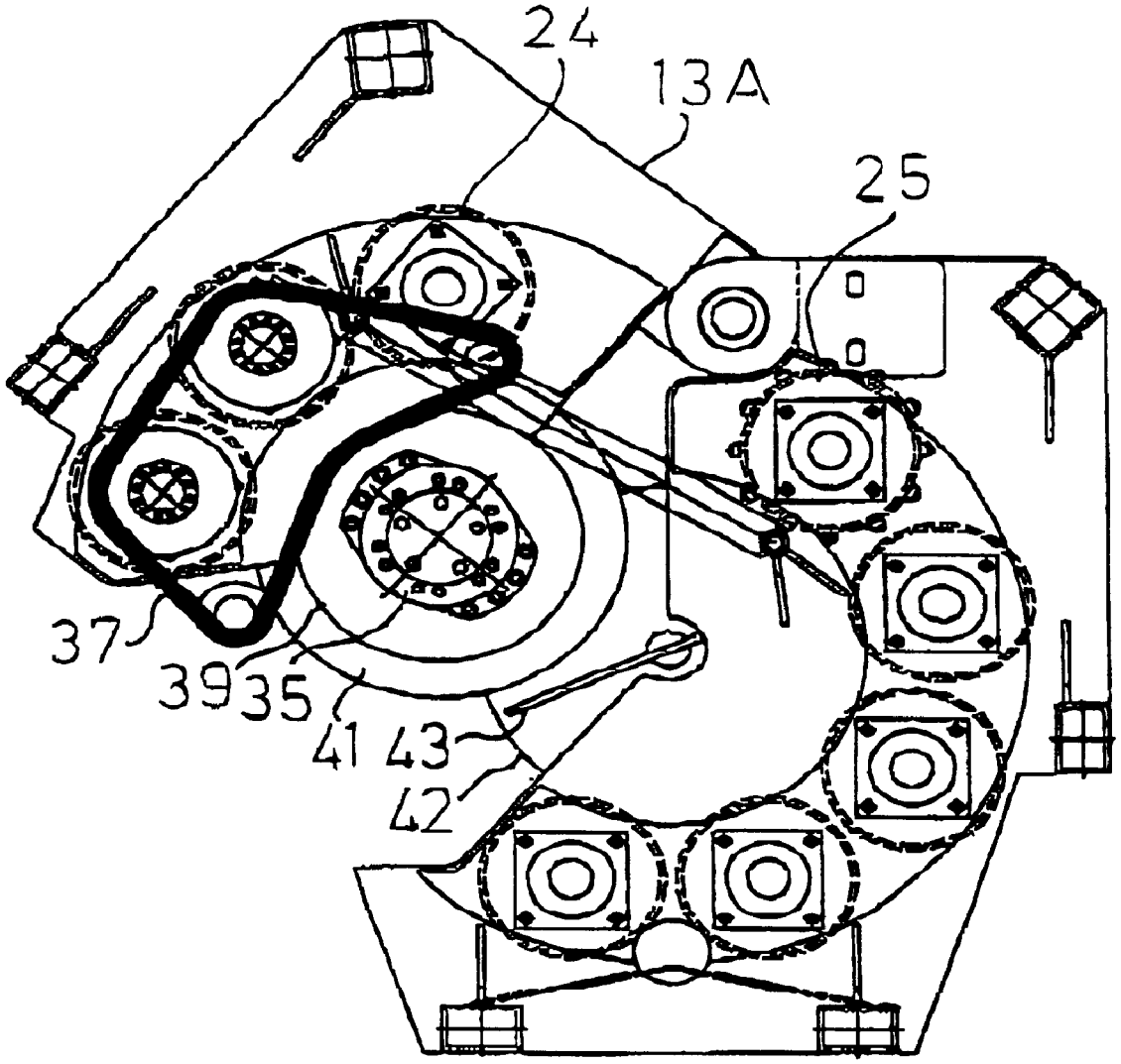

A preferred embodiment of the apparatus according to the invention is shown in FIGS. 7–9, in which FIG. 7 shows the apparatus in a view from the top, FIG. 8 shows the apparatus in a view from the right side of FIG. 7 and FIG. 9 shows the apparatus in a view from the left side of FIG. 7. In FIG. 8 the apparatus is shown at its operating position, and in FIG. 9 it is shown in opened position for removing a completed log. For the operation of the apparatus there are two synchronously operating hydraulic engines 35, 36 which by means of sprockets 39, 40 and chain 37, 38 operate the individual rolls 5. One of the engines 35 is mounted onto a movable side wall part 13A and operates those rolls which are mounted at the movable side wall parts 13A, 13B while the other engine is mounted onto a fixed side wall part and operates the other rolls. Directly mounted onto the outgoing shaft of each of the engines there is a disc 41, 42 which form the inner surfaces of the side walls. The diameter of the discs 41, 42 corresponds to the cylindrical space which is delimited by the rolls 5. Preferably there is on each disc a bar 43 which functions as a carrier for the goods which is supplied to the equipment. By the rotating discs 41, 42 and the bars 43 the supplied goods immediately rotate along in the direction of rotation of the discs, which is the same as the direction of rotation of those parts of the rolls 5 which are facing the goods. The relation between the speed of rotation of the rolls 5 and of the discs 41, 42 is determined by the diameter of the sprockets.

What is claimed is:

1. Method for making a product in the shape of a log from wastes from forestry wherein goods including forestry wastes which are to be included in the log are fed into a delimited space which defines the outer shape of the log and are there rotated along the lengthwise axis of the log at such a speed that the goods which have been fed in are compressed mainly by the influence of centrifugal force.

2. Method according to claim 1 wherein the goods are rotated at a speed of 50–90 rounds per minute.

3. Method according to claim 2 wherein the speed of rotation is about 70 rounds per minute.

4. Apparatus for the compression of wastes from forestry to form a log comprising:

feeder rolls which define a feed in opening, and compression rolls which are mounted at a fixed part and a movable part of a frame so that the rolls during compression touch a surface which is defined by the outer surface of the log and to corotating side wall sides which together with the rolls define a space wherein compression takes place.

5. Apparatus according to claim 4 wherein a bar is arranged at the inside of rotating parts of the wide walls sides.

* * * * *